US010208560B2

(12) United States Patent
Marya

(10) Patent No.: US 10,208,560 B2
(45) Date of Patent: Feb. 19, 2019

(54) PRESSURE ACTUATED DISINTEGRATION OF BULK MATERIALS AND OILFIELD RELATED COMPONENTS

(71) Applicant: Schlumberger Technology Corporation, Sugar Land, TX (US)

(72) Inventor: Manuel P. Marya, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 264 days.

(21) Appl. No.: 14/913,545

(22) PCT Filed: Aug. 18, 2014

(86) PCT No.: PCT/US2014/051415

§ 371 (c)(1),
(2) Date: Feb. 22, 2016

(87) PCT Pub. No.: WO2015/026692

PCT Pub. Date: Feb. 26, 2015

(65) Prior Publication Data

US 2016/0201429 A1 Jul. 14, 2016

Related U.S. Application Data

(60) Provisional application No. 61/868,623, filed on Aug. 22, 2013.

(51) Int. Cl.

| | |
|---|---|
| ***B22F 3/02*** | (2006.01) |
| ***B22F 5/00*** | (2006.01) |
| ***E21B 33/134*** | (2006.01) |

(52) U.S. Cl.
CPC ..... *E21B 33/134* (2013.01); *B22F 3/02* (2013.01); *B22F 5/003* (2013.01)

(58) Field of Classification Search
CPC ..... E21B 34/134; E21B 34/1208; B22F 3/02; B22F 5/003; C22C 12/00; C22C 13/02;
(Continued)

(56) References Cited

U.S. PATENT DOCUMENTS

2007/0074873 A1 4/2007 McKeachnie et al.
2007/0181224 A1* 8/2007 Marya ..... C09K 8/805 148/400

(Continued)

OTHER PUBLICATIONS http://www.physlink.com/education/askexperts/ae132.cfm, "Why does increased pressure lower the melting point of ice?", downloaded May 14, 2018, 2 pages (Year: 2018).*

(Continued)

*Primary Examiner* — Jennifer H Gay

(57) ABSTRACT

A pressure disintegrable device includes a first volume that further includes a first portion and a second portion. The first portion is adapted to transmit a pressure applied to the first volume to a second portion disposed on the first portion. The second portion is adapted to decrease a melting point thereof as the transmitted pressure increases beyond a predetermined pressure. The pressure disintegrable device may also include a layer disposed on the first volume that is adapted to create a seal between the first volume and an external structure.

18 Claims, 11 Drawing Sheets

(58) Field of Classification Search
CPC ..... C22C 21/00; C22C 21/06; C22C 21/10; C22C 21/12; C22C 28/00; C22C 29/00
See application file for complete search history.

(56) References Cited

U.S. PATENT DOCUMENTS

| | | | | |
|---|---|---|---|---|
| 2008/0105438 | A1* | 5/2008 | Jordan | C22C 1/0408 166/376 |
| 2008/0271898 | A1 | 11/2008 | Turley et al. | |
| 2011/0048743 | A1* | 3/2011 | Stafford | E21B 33/134 166/386 |
| 2011/0315398 | A1 | 12/2011 | Ueland | |
| 2012/0080189 | A1* | 4/2012 | Marya | C09K 8/805 166/279 |
| 2016/0201429 | A1* | 7/2016 | Marya | E21B 33/134 166/376 |

OTHER PUBLICATIONS

Fujinaga, Yasuo, "The Relationship between the Eutectic and Melting Point Temperatures of Binary Alloys under High Pressure", Japanses Journal of Applied Physics, pp. 5215-5216 (Year: 2003).*
PCT/US2014/051415, International Search Report and Written Opinion, dated Nov. 27, 2014, 16 pgs.

* cited by examiner

PRESSURE ACTUATED DISINTEGRATION OF BULK MATERIALS AND OILFIELD RELATED COMPONENTS

CROSS-REFERENCE TO RELATED APPLICATIONS

This application is a non-provisional patent application of U.S. Provisional Patent Application Ser. No. 61/868,623, filed on Aug. 22, 2013, and entitled: "PRESSURE ACTUATED DISINTEGRATION OF BULK MATERIALS AND OILFIELD RELATED COMPONENTS." Accordingly, this non-provisional patent application claims priority to U.S. Provisional Patent Application Ser. No. 61/868,623 under 35 U.S.C. § 119(e). U.S. Provisional Patent Application Ser. No. 61/868,623 is hereby incorporated in its entirety.

BACKGROUND

Hydrocarbon fluids such as oil and natural gas are obtained from a subterranean geologic formation, referred to as a reservoir, by drilling a well that penetrates the hydrocarbon-bearing formation. Once a wellbore is drilled, various forms of well completion components may be installed in order to control and enhance the efficiency of producing the various fluids from the reservoir.

During production of hydrocarbon fluids from a well, it is sometimes helpful to temporarily isolate different zones of a well using an isolation component. Zones are linear sections of a well that may be at different depths. One commonly used isolation component is a slurry including a cement binder, filler materials such as sand and an aggregate such as pea gravel, and one or more fluids. The slurry is pumped down into a predetermined location within a well and the slurry is hardened to form concrete which creates an isolation component within the well. A tool such as a bridgeplug is also used as an isolation component. The bridge plug is lowered into the well to a predetermined location and the bridgeplug is actuated to create a seal that prevents fluids and gases from traversing along the length of the well.

Once the isolation component is in place, operations are performed on the isolated section of the well. For example, hydraulic fracturing may be employed to modify the production of the well in the isolated zone. Once the operations are complete, the isolation component is removed. Zone isolation may be used repeatedly to modify the production of the well.

SUMMARY

In general, in one aspect, a pressure disintegrable device includes a first volume that further includes a first portion and a second portion. The first portion transmits, to the second portion, pressure applied to the first volume. The melting temperature of the second portion, in response to the transmitted pressure, decreases as the transmitted pressure increases beyond a predetermined pressure.

In general, in one aspect, a method of operating a pressure disintegrable device includes applying a pressure to a first volume including a first portion and a second portion disposed on the first portion; transmitting, by the first portion, the pressure to the second portion in response to the pressure applied to the first volume; decreasing, by the second portion, a melting point of the second portion in response to the transmitted pressure; and changing, by the second portion, a state of the second portion from solid to liquid in response to the decrease in the melting point of the second portion.

In general, in one aspect, a method of producing a pressure disintegrable device includes obtaining a first plurality of grains of a first material and obtaining a second plurality of grains of a second material that decreases a melting point of the second material as an applied pressure increases beyond a predetermined pressure. The method further includes forming a first volume by consolidating the first plurality of grains to form a first portion and consolidating the second plurality of grains to form a second portion disposed on the first portion. The method further includes applying, to the first volume, a layer disposed on the first volume and adapted to create a seal between the first volume and an external structure.

Other aspects and advantages of the disclosure will be apparent from the following description and the appended claims.

BRIEF DESCRIPTION OF DRAWINGS

Certain embodiments of the disclosure will hereafter be described with reference to the accompanying drawings. It should be understood, however, that the accompanying drawings illustrate the various implementations described herein and are not meant to limit the scope of various technologies described herein. The drawings show and describe various embodiments of the current disclosure.

DETAILED DESCRIPTION

Figure 1:
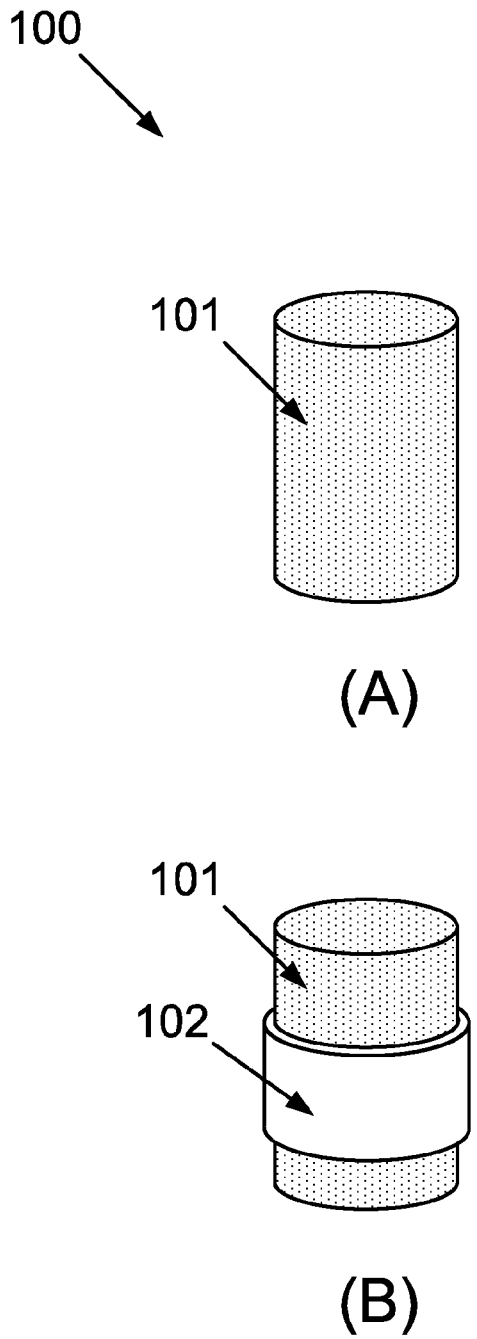
FIGS. 1(A) and (B) show a pressure disintegrable device in accordance with one or more embodiments.

Specific embodiments will now be described in detail with reference to the accompanying figures. Numerous details are set forth to provide an understanding of the present disclosure. However, it will be understood by those skilled in the art that the embodiments of the present disclosure may be practiced without these details and that numerous variations or modifications from the described embodiments may be possible.

In the specification and appended claims: the terms "connect," "connection," "connected," "in connection with," and "connecting" are used to mean "in direct connection with" or "in connection with via one or more elements;" and the term "set" is used to mean "one element" or "more than one element." Further, the terms "couple," "coupling," "coupled," "coupled together," and "coupled with" are used to mean "directly coupled together" or "coupled together via one or more elements." As used herein, the terms "up" and "down," "upper" and "lower," "upwardly" and downwardly," "upstream" and "downstream;" "above" and "below;" and other like terms indicating relative positions above or below a given point or element are used in this description to more clearly describe some embodiments of the disclosure.

Embodiments may take the form of heterogeneous materials, devices, and methods of operating devices that structurally fail when exposed to a pressure greater than or equal to a predetermined pressure. In one or more embodiments, a heterogeneous material includes a first portion that does not decrease its melting point as pressure increases. In one or more embodiments, the heterogeneous material also includes a second portion that decreases its melting point as an externally applied pressure is increased beyond a predetermined pressure. In one or more embodiments, the first portion and second portion are arranged to form a heterogeneous material that disintegrates when an externally applied pressure is equal to or greater than a predetermined pressure and predetermined temperature. In one or more embodiments, the disintegration is caused by the second portion changing from a solid to a liquid in response to an applied pressure and applied temperature. In one or more embodiments, the applied temperature may simply be the ambient temperature while in other embodiments a heating source may raise the temperature of the second material to facilitate changing the phase of the second material from solid to liquid.

In accordance with one or more embodiments, devices and materials may take the form of oilfield-related components or materials such as balls, plugs, darts, receptacles or seats, anchors, collets, pressure housings, flow-thru housings, mandrels, or any other isolation component. Devices and materials may also take the form of components that are formed in situ using cements. In one or more embodiments, cement is a binding material that is mixed with other materials such as gravel, sand, and one or more liquids to form a workable material or a slurry that hardens into a solid over a period of time. The components or materials are used to isolate sections of a well. For example, a ball may be used in conjunction with a pre-existing seat located in a well to block the flow of fluids and gases by forming a seal when the ball is pressed against the seat. A plug or a cement may also be used to block the flow of fluids and gases by sealing the entire cross section of the well.

In accordance with one or more embodiments, FIG. 1 shows a pressure disintegrable device (100). More specifically, FIG. 1(A) shows pressure disintegrable device (100) including a first volume (101). The first volume (101) is adapted to disintegrate when an applied pressure is greater than or equal to a predetermined pressure. In one or more embodiments, the first volume (101) is composed of a heterogeneous material which will be described in further detail later. In one or more embodiments, the pressure disintegrable device (100) may include a layer (102), as shown in FIG. 1(B), disposed on the first volume (101) and adapted to create a seal between the first volume and an external structure (not shown). In one or more embodiments, the layer (102) may be a rubber, polymer, or any other material that could create a seal between the first volume and an external structure. In one or more embodiments, the layer (102) may cover the entire first volume (101) or part of the first volume (101).

Figure 2:
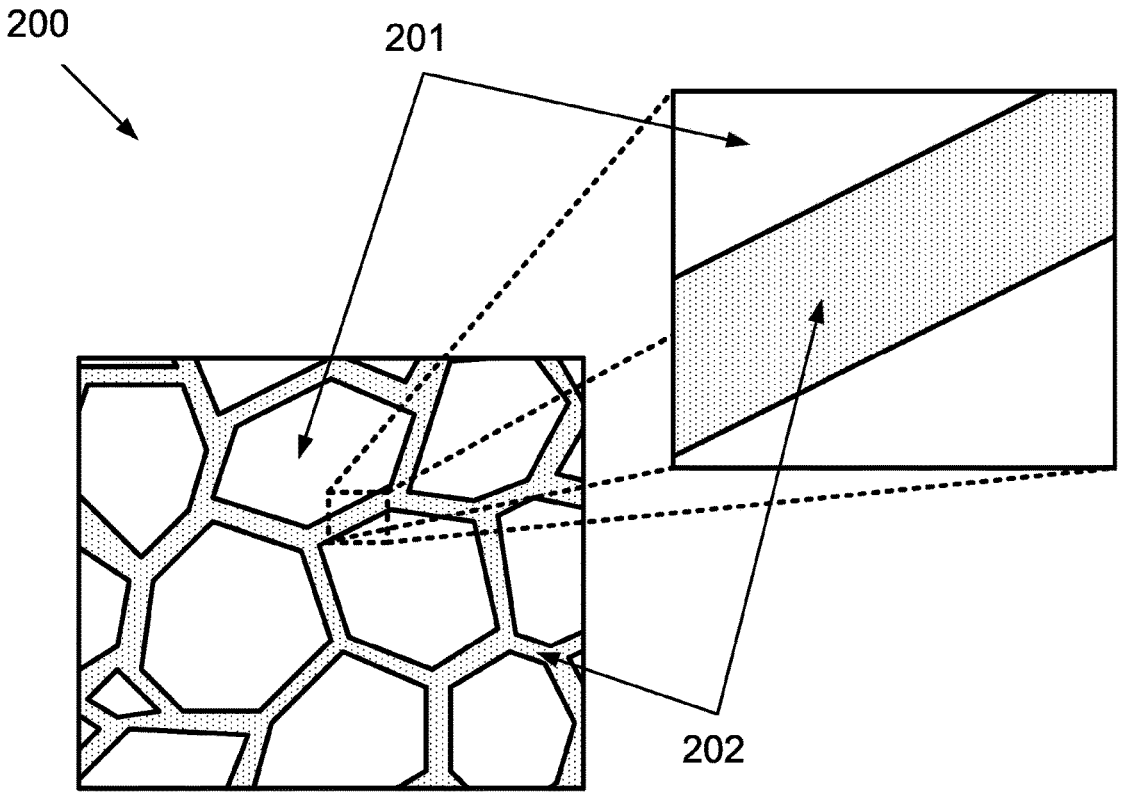
FIG. 2 shows a schematic representation of a heterogeneous material in accordance with one or more.

In accordance with one or more embodiments, FIG. 2 shows a schematic representation of the heterogeneous material (200) of which the first volume (101) is composed. More specifically, FIG. 2 shows a heterogeneous material (200) including a first portion (201) and a second portion (202). In one or more embodiments, the heterogeneous material (200) is an alloy that is heterogeneous at the microscopic level. In one or more embodiments, the heterogeneous material (200) is a mixture and is heterogeneous at the macroscopic level, for example a slurry including a cement binder or a powder infused polymer. The first portion (201) is composed of a material that does not decrease its melting point as pressure increases. In one or more embodiments, the first portion (201) is a metal or metal alloy containing iron, nickel, cobalt, titanium, copper, aluminum, zinc, and magnesium. In one or more embodiments, the first portion (201) is polymeric such as PEEK, epoxies, or Teflon. In one or more embodiments, the first portion (201) is a ceramic such as an oxide, nitride, silicide, boride, or carbide. In one or more embodiments, the first portion (201) is a ceramic material comprising at least one compound selected from the group containing oxides, nitrides, carbides, borides, and silicides. In one or more embodiments, the first portion (201) is alumina or magnesia. In one or more embodiments, the first portion (201) is a glass.

In one or more embodiments, the second portion (202) is composed of a material that decreases its melting point as an externally applied pressure is increased beyond a predetermined pressure. In one or more embodiments, the second portion (202) is bismuth, lead, tin, cadmium, germanium, silicon, antimony, gallium, zinc, copper, silver, and gold. In one or more embodiments, the second portion (202) is an alloy including at least one of bismuth, lead, tin, cadmium, germanium, silicon, antimony, gallium, zinc, copper, silver, and gold.

In one or more embodiments, the second portion (202) is an alloy containing 44.7% bismuth, 22.6% lead, 19.1% indium, 8.3% tin, and 5.3% cadmium. In one or more embodiments, the second portion (202) is an alloy containing 49% bismuth, 21% indium, 18% lead, and 12% tin. In one or more embodiments, the second portion (202) is an alloy containing 48% bismuth, 25.6% lead, 4% indium, 12.8% tin, and 9.6% cadmium. In one or more embodiments, the second portion (202) is an alloy containing 50% bismuth, 26.7% lead, 13.3% tin, and 10% cadmium. In one or more embodiments, the second portion (202) is an alloy containing 42.5% bismuth, 37.7% lead, 11.3% tin, and 8.5% cadmium. In one or more embodiments, the second portion (202) is an alloy containing 48% bismuth, 28.5% lead, 14.5% tin, and 9% antimony. In one or more embodiments, the second portion (202) is an alloy containing 55.5% bismuth and 44.5% lead. In one or more embodiments, the second portion (202) is an alloy containing 58% bismuth and 42% tin. In one or more embodiments, the second portion (202) is an alloy containing 60% tin and 40% bismuth.

In one or more embodiments, the second portion (202) is a mixture of one or more organometallic compound of bismuth, lead, tin, cadmium, germanium, silicon, antimony, gallium, zinc, copper, silver, and gold. In one or more embodiments, the second portion (202) is a mixture of one or more oxides of bismuth, lead, tin, cadmium, germanium, silicon, antimony, gallium, zinc, copper, silver, and gold. In one or more embodiments, the second portion (202) is a mixture of one or more hydroxides of bismuth, lead, tin, cadmium, germanium, silicon, antimony, gallium, zinc, copper, silver, and gold. In one or more embodiments, the second portion (202) is a mixture of one or more nitrides of bismuth, lead, tin, cadmium, germanium, silicon, antimony, gallium, zinc, copper, silver, and gold. In one or more embodiments, the second portion (202) is a mixture of one or more oxi-nitrides of bismuth, lead, tin, cadmium, germanium, silicon, antimony, gallium, zinc, copper, silver, and gold. In one or more embodiments, the second portion (202) is a mixture of one or more silicides of bismuth, lead, tin, cadmium, germanium, silicon, antimony, gallium, zinc, copper, silver, and gold. In one or more embodiments, the second portion (202) is a mixture of one or more borides bismuth, lead, tin, cadmium, germanium, silicon, antimony, gallium, zinc, copper, silver, and gold. In one or more embodiments, the second portion (202) is an alloy or intermetallic phases containing at least two of the following: bismuth, lead, tin, cadmium, germanium, silicon, antimony, gallium, zinc, copper, silver, and gold.

In accordance with one or more embodiments, the second portion (202) may include both one or more metals previously described and one or more organometallic compounds, oxide compounds, hydroxide compounds, nitride compounds, oxi-nitride compounds, silicide compounds, or boride compounds previously described.

In one or more embodiments the heterogeneous material (200) includes, at least, 2% by volume second portion (202). In one or more embodiments the heterogeneous material (200) includes less than 98% by volume first portion (201). In one or more embodiments, the first portion (201) is alumina and occupies 95% or more of the volume of the heterogeneous material (200) and the second portion (202) is bismuth or any of the previously materials disclosed materials that could be used to form the second portion (202) and occupies 5% or less of the volume of the heterogeneous material (200). In one or more embodiments, the first portion (201) is alumina and occupies 80% or more of the volume of the heterogeneous material (200) and the second portion (202) is bismuth or any of the previously materials disclosed materials that could be used to form the second portion (202) and occupies 20% or less of the volume of the heterogeneous material (200).

In one or more embodiments, the first portion (201) is a plurality of separate grains as seen in FIG. 2. The grains may be of any size and any shape. In one or more embodiments, the grains correspond to grains in an alloy. In one or more embodiments, the grains correspond to aggregate in a slurry containing a cement binder material or a powder infused polymer. In some embodiments the grains are physically separated from one another while in other embodiments the grains physically touch each other. In the embodiment shown in FIG. 2, each grain is physically separated by some distance from the other grains of the plurality of grains. The space between each grain is filled with the second portion (202) as seen in the expanded area illustrated in FIG. 2.

Figure 3:
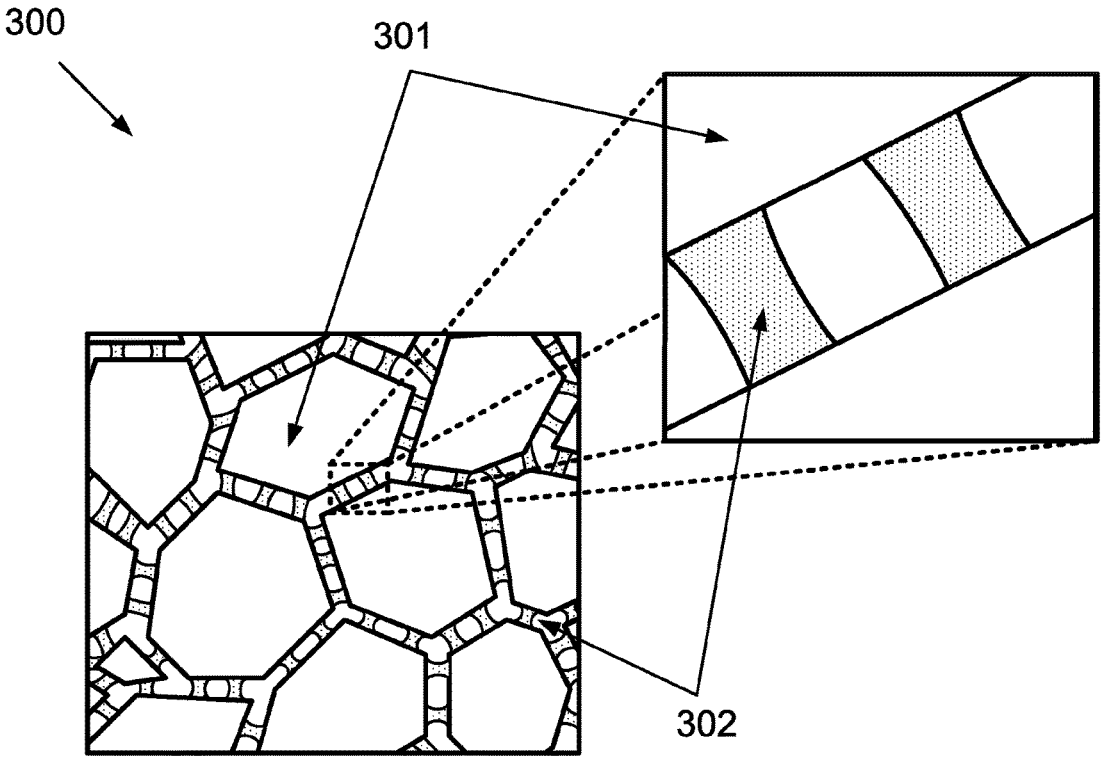
FIG. 3 shows a schematic representation of a heterogeneous material in accordance with one or more embodiments.

In accordance with another embodiment, FIG. 3 shows a schematic representation of the heterogeneous material (300) of which the first volume (101) is composed. The embodiment shown in FIG. 3 shows a heterogeneous material (300) including a first portion (301) and a second portion (302) with properties identical to those of first portion (201) and second portion (202) shown in FIG. 2. Unlike the embodiment shown in FIG. 2, the embodiment shown in FIG. 3 includes a second portion (302) that partially fills the space between each grain. Some of the space between each grain of the plurality of grains comprising the first portion (301) is vacant. Inclusion of vacant space in the second portion (302) adjusts the pressure and temperature at which a pressure disintegrable device (100) disintegrates.

Figure 4:
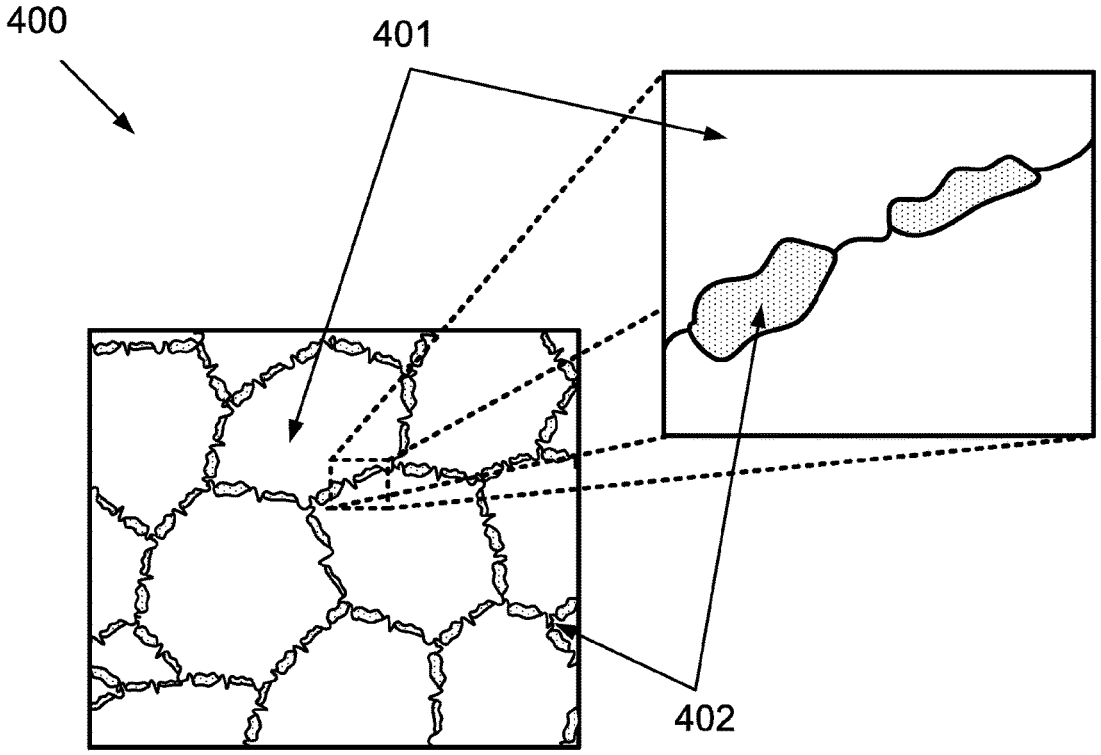
FIG. 4 shows a schematic representation of a heterogeneous material in accordance with one or more embodiments.

In accordance with another embodiment, FIG. 4 shows a schematic representation of the heterogeneous material (400) of which the first volume (101) is composed. The embodiment shown in FIG. 4 shows a heterogeneous material (400) including a first portion (401) and a second portion (402) with properties identical to those of first portion (201) and second portion (202) shown in FIG. 2. Unlike the embodiment shown in FIG. 2, the embodiment of FIG. 4 shows that the plurality of grains comprising the first portion (401) are tightly packed together and physically touch each other. The second portion (402) in this embodiment is a plurality of separate, unconnected areas located between the grains. Increasing the grain packing and separating the second portion (402) adjusts the pressure and temperature at which a pressure disintegrable device (100) disintegrates.

Figure 5:
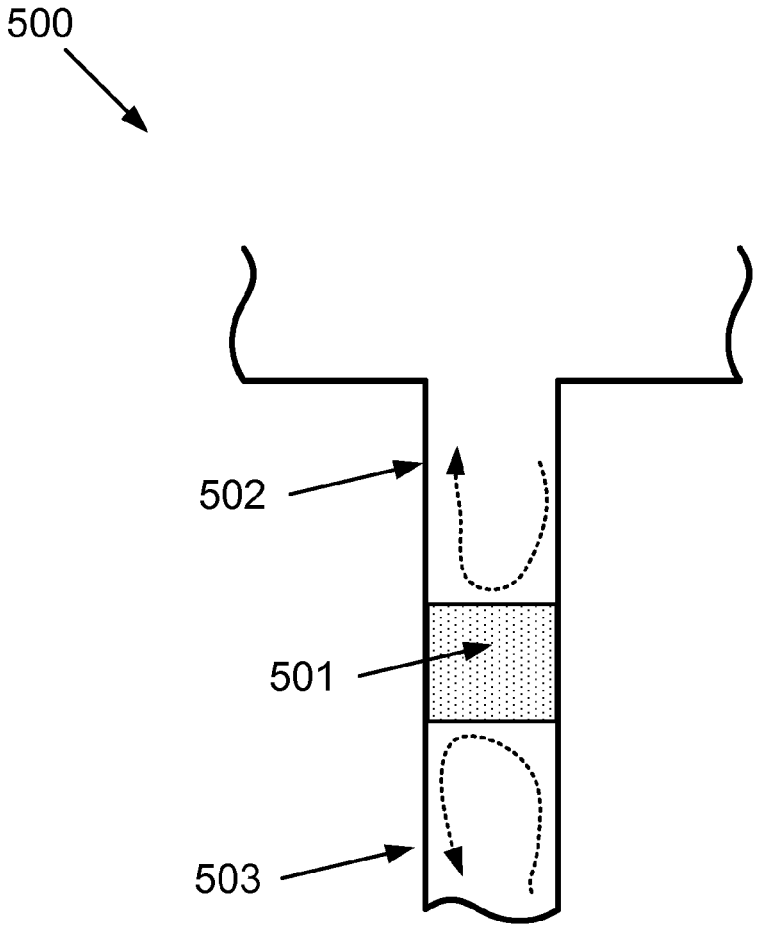
FIG. 5 shows an example operation of a pressure disintegrable device in accordance with one or more embodiments.
Figure 6:
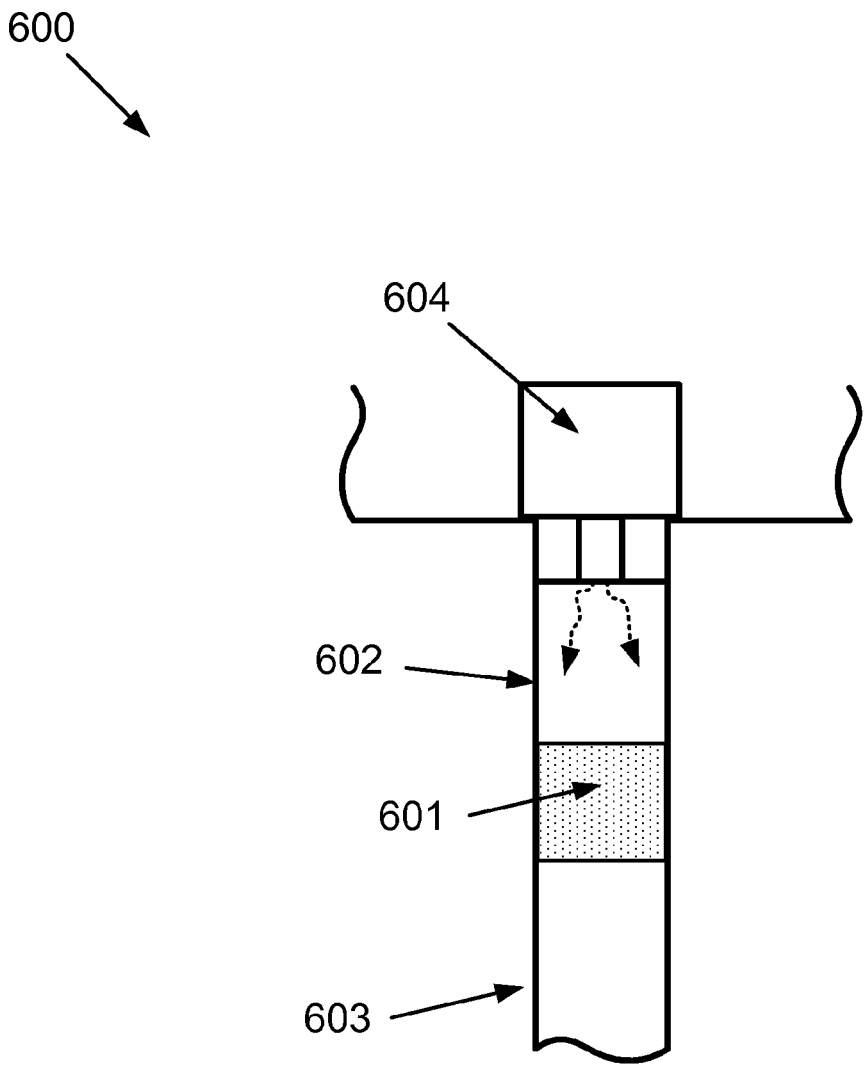
FIG. 6 shows an example operation of a pressure disintegrable device in accordance with one or more embodiments.
Figure 7:
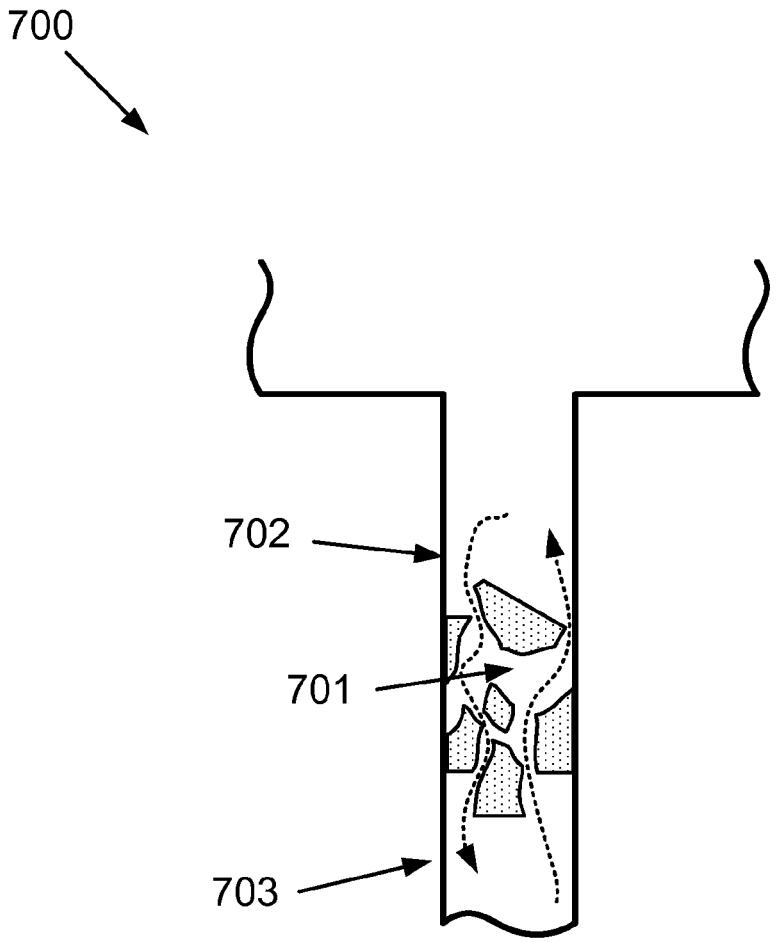
FIG. 7 shows an example operation of a pressure disintegrable device in accordance with one or more embodiments.

In accordance with one or more embodiments, FIGS. 5-7 show an operation of the pressure disintegrable device (100). Specifically, FIG. 5 shows a pressure disintegrable device (501) that is reversibly isolating a first zone (502) from a second zone (503) in a well. Under ambient conditions, the pressure disintegrable device (501) prevents fluids and gases from traversing from the first zone (502) to the second zone (503) and vice versa. The isolation of fluids and gases is indicated by the arrows with dashed tails as shown in FIG. 5. In one or more embodiments, the pressure disintegrable device (501) is a single unit at the surface and is lowered into the well before isolating the first zone (502) from the second zone (503). In one or more embodiments, the pressure disintegrable device (501) is a slurry that includes cement binder at the surface and is pumped into the well at a desired location to form the pressure disintegrable device (501) before isolating the first zone (502) from the second zone (503).

In accordance with one or more embodiments, FIG. 6 shows a pressure disintegrable device (601) and a pressure application unit (604) that is applying a pressure to the pressure disintegrable device (601). In one or more embodiments, the pressure application unit (604) may apply a continuous pressure or pressure pulses to the pressure disintegrable device (601). In the case of application of a continuous pressure, the pressure in the first zone (602) increases and the pressure is transmitted to the pressure disintegrable device (601). In the case of application of pressure pulses, pulses of pressure are applied to the first zone (602) and the pulses are transmitted to the pressure disintegrable device (601). When a predetermined pressure and a predetermined temperature is applied to the pressure disintegrable device (601), the second portion (202) changes state from a solid to a liquid.

In accordance with one or more embodiments, FIG. 7 shows a pressure disintegrable device (701) after a pressure and a temperature equal to or greater than the predetermined pressure and predetermined temperature. More specifically, FIG. 7 shows the pressure disintegrable device (701) disintegrating into a number of pieces. The disintegration of the pressure disintegrable device is caused by the second portion (202) changing state from a solid to a liquid in response to the applied pressure and applied temperature. When the second portion (202) changes state, the structural integrity of the pressure disintegrable device (701) fails nearly instantly. In FIG. 7, the pressure disintegrable device (701) breaks down into six large chunks but in practice the pressure disintegrable device (701) may disintegrate into any number of pieces of any size. Once the pressure disintegrable device (701) disintegrates, the pressure disintegrable device (701) no longer isolates the first zone (702) from the second zone (703) and fluids and gases are no longer restricted from traversing between the first zone (702) and second zone (703).

A person of ordinary skill in the art will recognize that the operation of the pressure disintegrable device (101) shown in FIGS. 5-7 is an example and should not be construed to limit the operation of the pressure disintegrable device (101) to well or oil field operations. The pressure disintegrable device (101) may be operated to reversibly isolate any type of structure.

Figure 8:
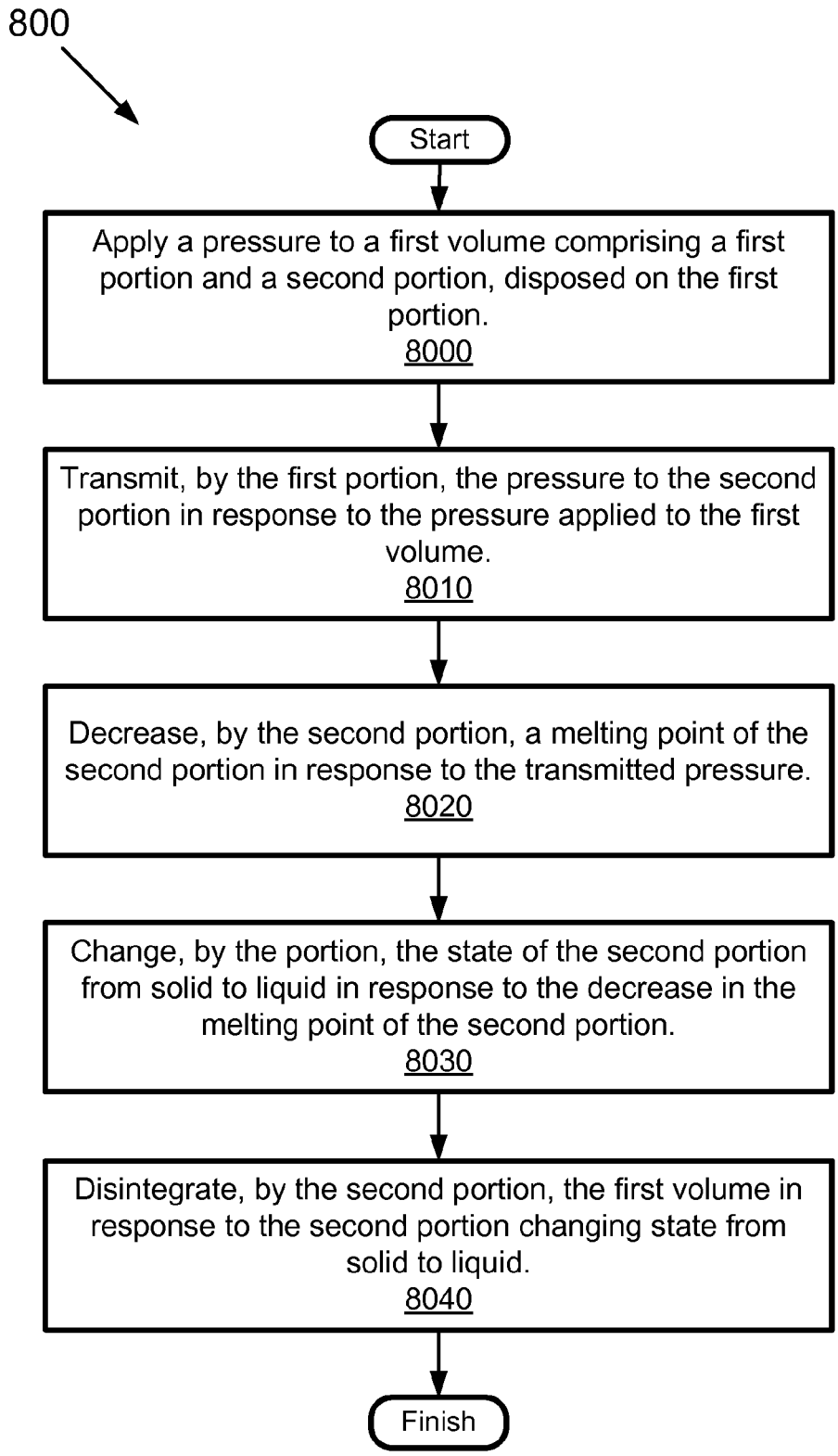
FIG. 8 shows a flow chart of a method in accordance with one or more embodiments.

FIG. 8 shows a flowchart (800) in accordance with one or more embodiments. The method depicted in FIG. 8 may be used to operate the pressure disintegrable device (100). One or more parts shown in FIG. 8 may be omitted, repeated, and/or performed in a different order among different embodiments. Accordingly, embodiments should not be considered limited to the specific number and arrangement shown in FIG. 8.

Initially, at 8000, a pressure is applied to a first volume (101) within a pressure disintegrable device (100) comprising a first portion (201) and a second portion (202), disposed on the first portion (201). In 8010, the pressure is transmitted by the first portion (201) to the second portion (202) in response to the pressure applied to the first volume (101). In 8020, the melting point of the second portion (202) decreases in response to the transmitted pressure. In 8030, the second portion (202) changes state from a solid to a liquid in response to the decrease in melting point of the second portion (202). In 8040, the first volume (100) disintegrates in response to the second portion changing state from solid to liquid (202).

Figure 9:
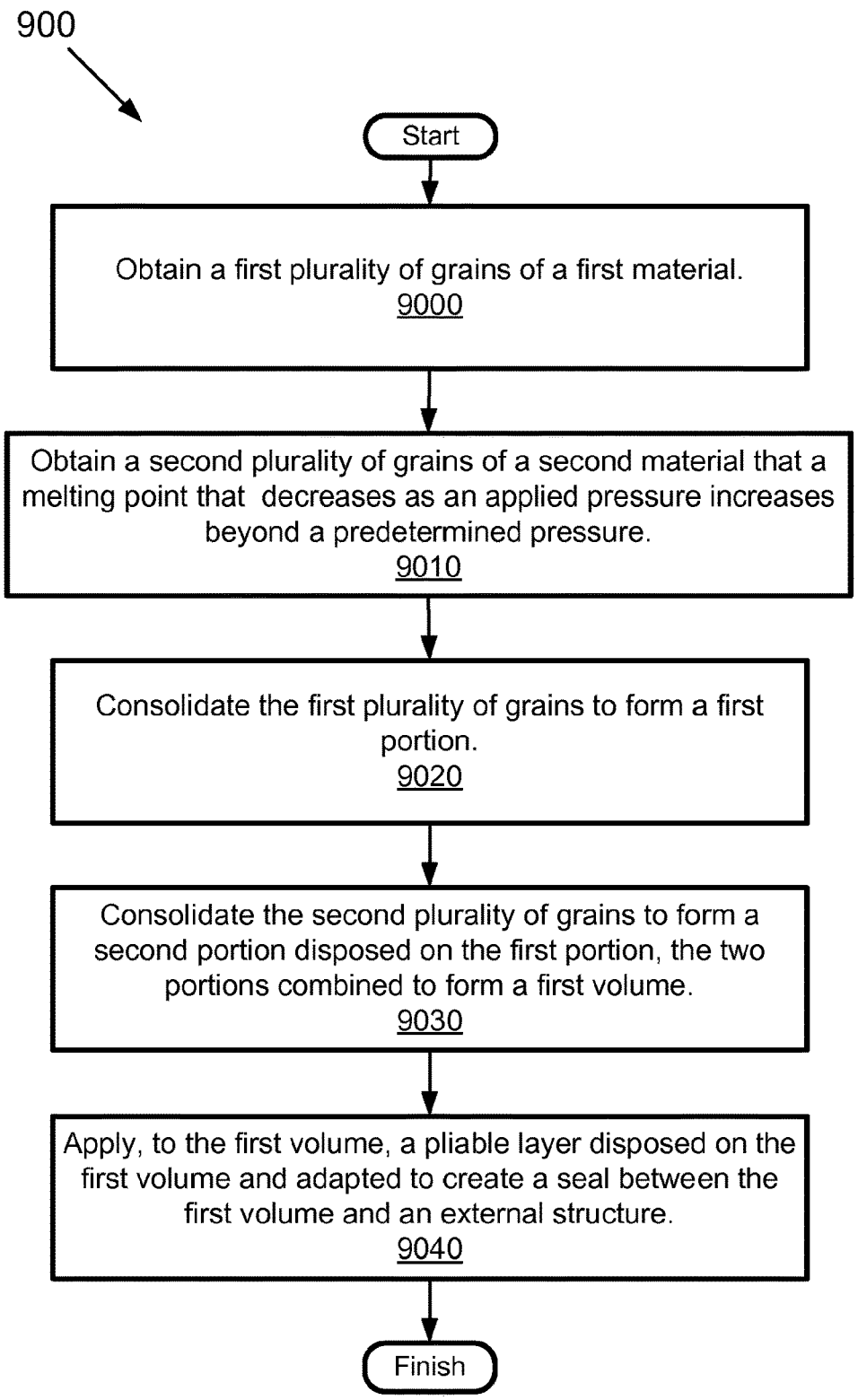
FIG. 9 shows a flow chart of a method in accordance with one or more embodiments.

FIG. 9 shows a flowchart (900) in accordance with one or more embodiments. The method depicted in FIG. 9 may be used to produce the pressure disintegrable device (100). One or more parts shown in FIG. 9 may be omitted, repeated, and/or performed in a different order among different embodiments. Accordingly, embodiments should not be considered limited to the specific number and arrangement shown in FIG. 9.

Initially, at 9000, a first plurality of grains of a first material is obtained. In 9010, a second plurality of grains of a second material that decreases its melting point as an applied pressure increases beyond a predetermined pressure is obtained. In 9020, the first plurality of grains is consolidated to form a first portion (201). In 9030, the second plurality of grains is consolidated to form a second portion disposed on the first portion. The combination of the first portion (201) and second portion (202) is a first volume. In one or more embodiments, the first plurality of grains and second plurality of grains are consolidated by powder metallurgy, melting and subsequent processing to form an alloy, or additive manufacturing such as laser sintering of powders, direct metal laser sintering, or inkjet printing of adhesives onto powder beds and subsequent sintering of the adhered powder beds. In 9040, a pliable layer (102) is applied to the first volume. In one or more embodiments, the pliable layer (102) is disposed on the first volume and covers a portion of the first volume. In one or more embodiments, the pliable layer (102) covers the entire first volume (201) or encapsulates the first volume (101).

Figure 10:
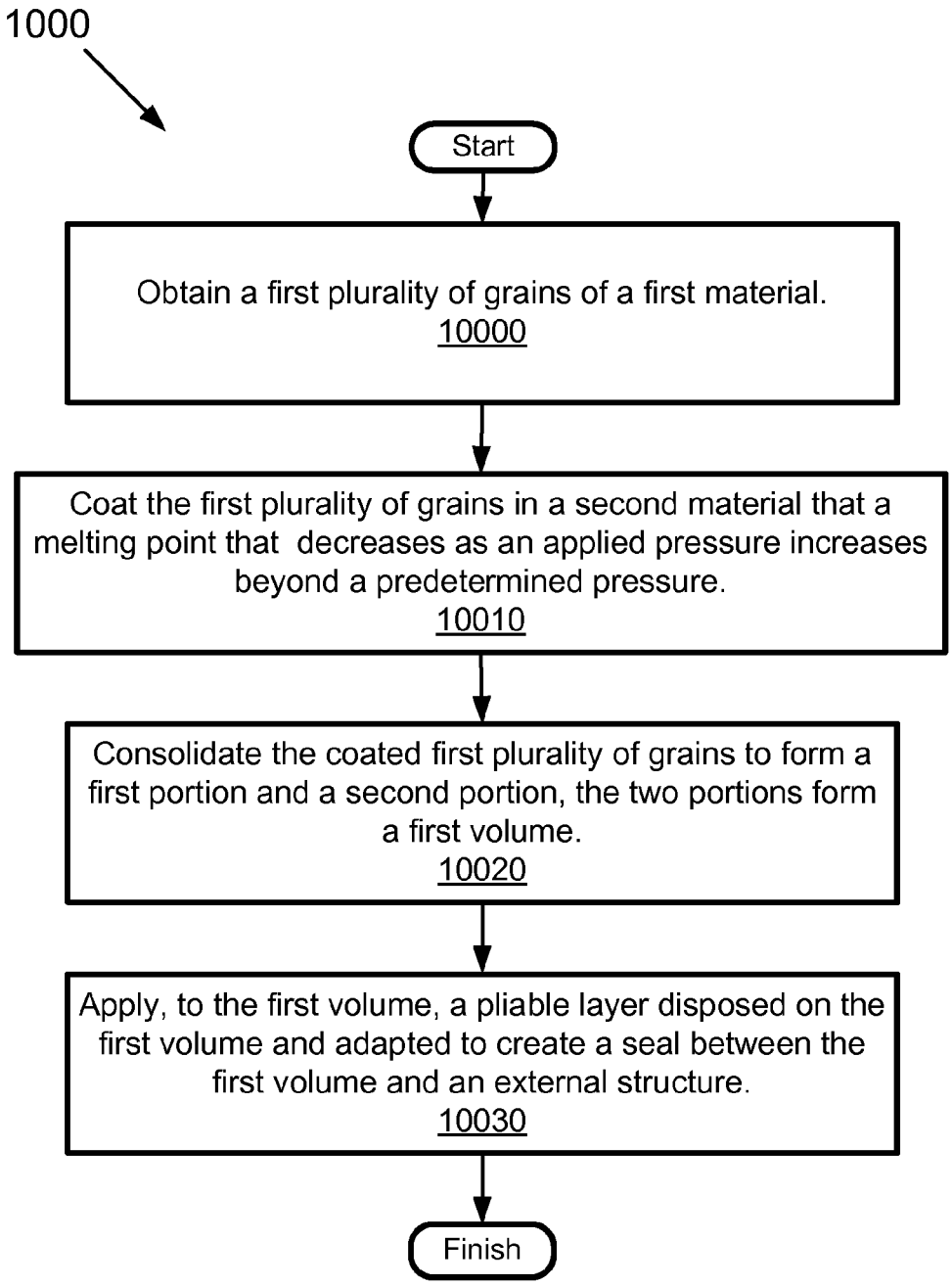
FIG. 10 shows a flow chart of a method in accordance with one or more embodiments.

FIG. 10 shows a flowchart (1000) in accordance with one or more embodiments. The method depicted in FIG. 10 may be used to produce the pressure disintegrable device (100). One or more parts shown in FIG. 10 may be omitted, repeated, and/or performed in a different order among different embodiments. Accordingly, embodiments should not be considered limited to the specific number and arrangement shown in FIG. 10.

Initially, at 10000, a first plurality of grains of a first material is obtained. In 10010, the first plurality of grains is coated in a second material that decreases its melting point as an applied pressure increases beyond a predetermined pressure. In 10020, the coated first plurality of grains is consolidated to form a first portion (201) and second portion (202), the two portions combined to form a first volume (101). The combination of the first portion (201) and second portion (202) is a first volume. In one or more embodiments, the coated first plurality of grains are consolidated by powder metallurgy, melting and subsequent processing to form an alloy, or additive manufacturing such as laser sintering of powders, direct metal laser sintering, or inkjet printing of adhesives onto powder beds and subsequent sintering of the adhered powder beds. In 9040, a pliable layer (102) is applied to the first volume. In one or more embodiments, the pliable layer (102) is disposed on the first volume and covers a portion of the first volume. In one or more embodiments, the pliable layer (102) covers the entire first volume (201) or encapsulates the first volume (101).

Figure 11:
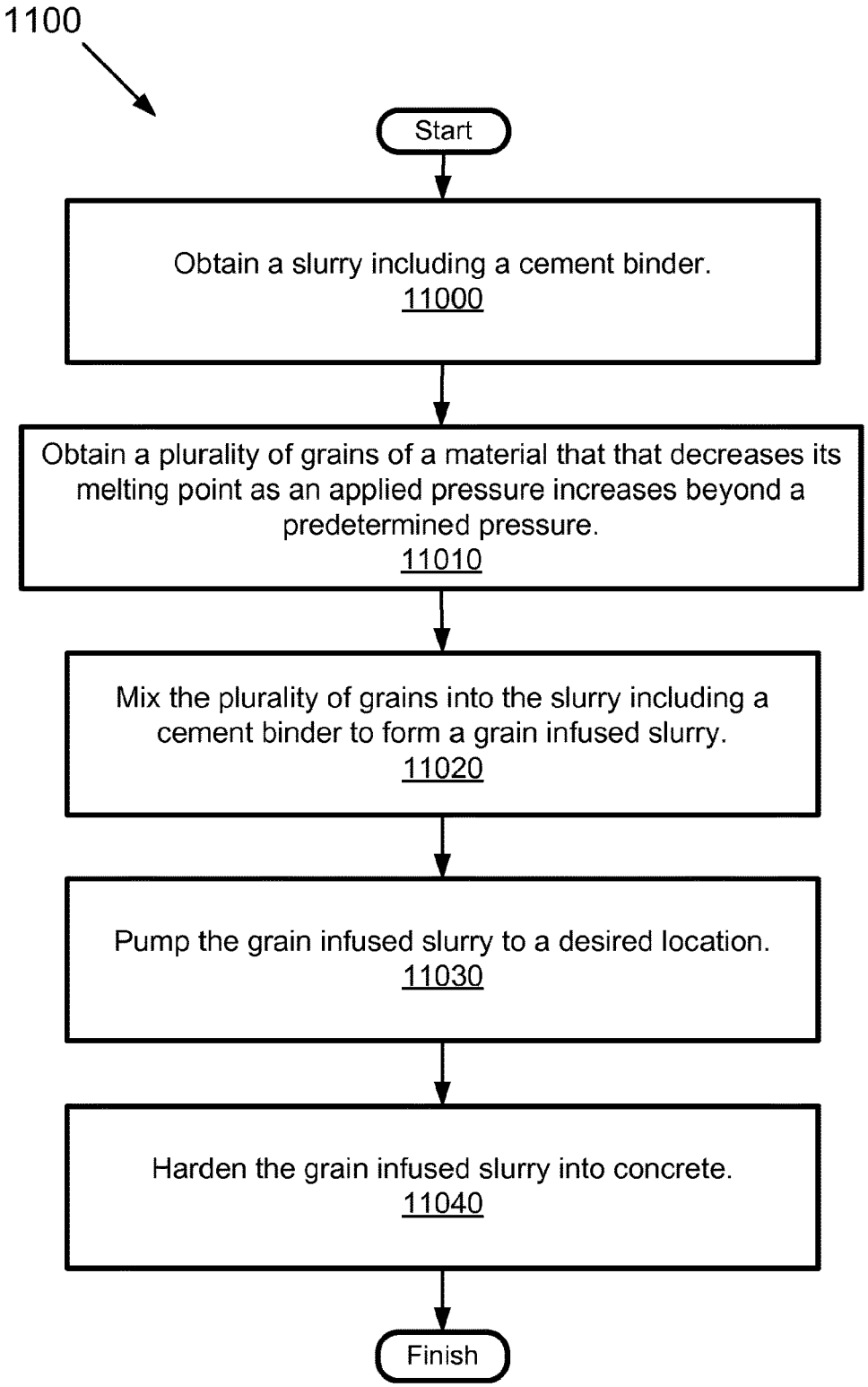
FIG. 11 shows a flow chart of a method in accordance with one or more embodiments.

FIG. 11 shows a flowchart (1100) in accordance with one or more embodiments. The method depicted in FIG. 11 may be used to produce the pressure disintegrable device (100). One or more parts shown in FIG. 11 may be omitted, repeated, and/or performed in a different order among different embodiments. Accordingly, embodiments should not be considered limited to the specific number and arrangement shown in FIG. 11.

Initially, at 11000, a slurry including a cement binder is obtained. In 11010, a plurality of grains of a material that decreases its melting point as an applied pressure increases beyond a predetermined pressure is obtained in the form of a powder, pea gravel, or aggregate. In 11020, the plurality of grains is mixed into the slurry including a cement binder to form a grain infused slurry. In 11030, the grain infused slurry is pumped to a desired location. In 11040, the grain infused slurry is hardened into concrete where the cement binder in the slurry in the concrete corresponds to a first portion (201), the infused plurality of grains in the concrete corresponds to a second portion (202), and the first and second portion are a first volume (101).

While a limited number of embodiments have been described above, those skilled in the art, having the benefit of this disclosure, will appreciate that other embodiments can be devised which do not depart from the scope as disclosed herein. Accordingly, the scope should be limited by the attached claims.

What is claimed is:

1. A pressure disintegrable device, comprising:

a first volume comprising:

a first portion adapted to transmit a pressure applied to the first volume to a second portion disposed on the first portion, wherein the second portion is adapted to decrease a melting point thereof as the pressure increases beyond a predetermined pressure; and a layer disposed on the first volume and adapted to create a seal between the first volume and an external structure.

2. The pressure disintegrable device of claim 1, wherein the second portion is an alloy comprising at least one metal selected from the group consisting of bismuth, lead, tin, cadmium, germanium, silicon, antimony, gallium, zinc, copper, silver, and gold.

3. The pressure disintegrable device of claim 1, wherein the second portion is a mixture of organometallic compounds comprising at least one organometallic compound selected from the group consisting of an organometallic compound of bismuth, an organometallic compound of lead, an organometallic compound of tin, an organometallic compound of cadmium, an organometallic compound of germanium, an organometallic compound of silicon, an organometallic compound of antimony, an organometallic compound of gallium, an organometallic compound of zinc, an organometallic compound of copper, an organometallic compound of silver, and an organometallic compound of gold.

4. The pressure disintegrable device of claim 1, wherein the second portion is a mixture of compounds comprising one compound selected from the group consisting of an inorganic compound of bismuth, an inorganic compound of lead, an inorganic compound of tin, an inorganic compound of cadmium, an inorganic compound of germanium, an inorganic compound of silicon, antimony, an inorganic compound of gallium, an inorganic compound of zinc, an inorganic compound of copper, an inorganic compound of silver, an inorganic compound of gold, a ceramic compound of bismuth, a ceramic compound of lead, a ceramic compound of tin, a ceramic compound of cadmium, a ceramic compound of germanium, a ceramic compound of silicon, a ceramic compound of antimony, a ceramic compound of gallium, a ceramic compound of zinc, a ceramic compound of copper, a ceramic compound of silver, and a ceramic compound of gold.

5. The pressure disintegrable device of claim 1, wherein the second portion comprises:

at least one metal and at least one compound;

wherein the at least one metal is selected from the group consisting of bismuth, lead, tin, cadmium, germanium, silicon, antimony, gallium, zinc, copper, silver, and gold; and wherein the at least one compound is selected from the group consisting of an organometallic compound of bismuth, an organometallic compound of lead, an organometallic compound of tin, an organometallic compound of cadmium, an organometallic compound of germanium, an organometallic compound of silicon, an organometallic compound of antimony, an organometallic compound of gallium, an organometallic compound of zinc, an organometallic compound of copper, an organometallic compound of silver, an organometallic compound of gold, an inorganic compounds of bismuth, an inorganic compound of lead, an inorganic compound of tin, an inorganic compound of cadmium, an inorganic compound of germanium, an inorganic compound of silicon, antimony, an inorganic compound of gallium, an inorganic compound of zinc, an inorganic compound of copper, an inorganic compound of silver, an inorganic compound of gold, a ceramic compound of bismuth, a ceramic compound of lead, a ceramic compound of tin, a ceramic compound of cadmium, a ceramic compound of germanium, a ceramic compound of silicon, a ceramic compound of antimony, a ceramic compound of gallium, a ceramic compound of zinc, a ceramic compound of copper, a ceramic compound of silver, and a ceramic compound of gold.

6. The pressure disintegrable device of claim 1, wherein the second portion occupies 2% to 20% of a volume of the first volume.

7. The pressure disintegrable device of claim 1, wherein the first portion is an alloy comprising at least one metal selected from the group consisting of aluminum, magnesium, titanium, iron, cobalt, nickel, copper, and zinc or the first portion is a ceramic material comprising at least one compound selected from the group consisting of oxides, nitrides, carbides, borides, and silicides.

8. A method of operating a pressure disintegrable device, comprising:

applying a pressure to a first volume comprising a first portion and a second portion disposed on the first portion, wherein a layer is disposed on the first volume and adapted to create a seal between the first volume and an external structure;

transmitting, by the first portion, the pressure to the second portion in response to a pressure applied to the first volume;

decreasing, by the second portion, a melting point of the second portion in response to the transmitted pressure; and changing, by the second portion, a state of the second portion from solid to liquid in response to the decrease in the melting point of the second portion.

9. The method of operating a pressure disintegrable device of claim 8, further comprising:

disintegrating, by the second portion, the first volume in response to the second portion changing the state from solid to liquid.

10. The method of operating a pressure disintegrable device of claim 8, wherein the second portion is an alloy comprising at least one metal selected from the group consisting of bismuth, lead, tin, cadmium, germanium, silicon, antimony, gallium, zinc, copper, silver, and gold.

11. The method of operating a pressure disintegrable device of claim 8, wherein the second portion is a mixture of organometallic compounds comprising at least one organometallic compound selected from the group consisting of an organometallic compound of bismuth, an organometallic compound of lead, an organometallic compound of tin, an organometallic compound of cadmium, an organometallic compound of germanium, an organometallic compound of silicon, an organometallic compound of antimony, an organometallic compound of gallium, an organometallic compound of zinc, an organometallic compound of copper, an organometallic compound of silver, and an organometallic compound of gold.

12. The method of operating a pressure disintegrable device of claim 8, wherein the second portion is a mixture of compounds comprising one compound selected from the group consisting of an inorganic compound of bismuth, an inorganic compound of lead, an inorganic compound of tin, an inorganic compound of cadmium, an inorganic compound of germanium, an inorganic compound of silicon, antimony, an inorganic compound of gallium, an inorganic compound of zinc, an inorganic compound of copper, an inorganic compound of silver, an inorganic compound of gold, a ceramic compound of bismuth, a ceramic compound of lead, a ceramic compound of tin, a ceramic compound of cadmium, a ceramic compound of germanium, a ceramic compound of silicon, a ceramic compound of antimony, a ceramic compound of gallium, a ceramic compound of zinc, a ceramic compound of copper, a ceramic compound of silver, and a ceramic compound of gold.

13. The method of operating a pressure disintegrable device of claim 8, wherein the second portion comprises:

at least one metal and at least one compound;

wherein the at least one metal is selected from the group consisting of bismuth, lead, tin, cadmium, germanium, silicon, antimony, gallium, zinc, copper, silver, and gold; and wherein the at least one compound is selected from the group consisting of an organometallic compound of bismuth, an organometallic compound of lead, an organometallic compound of tin, an organometallic compound of cadmium, an organometallic compound of germanium, an organometallic compound of silicon, an organometallic compound of antimony, an organometallic compound of gallium, an organometallic compound of zinc, an organometallic compound of copper, an organometallic compound of silver, an organometallic compound of gold, an inorganic compound of bismuth, an inorganic compound of lead, an inorganic compound of tin, an inorganic compound of cadmium, an inorganic compound of germanium, an inorganic compound of silicon, antimony, an inorganic compound of gallium, an inorganic compound of zinc, an inorganic compound of copper, an inorganic compound of silver, an inorganic compound of gold, a ceramic compound of bismuth, a ceramic compound of lead, a ceramic compound of tin, a ceramic compound of cadmium, a ceramic compound of germanium, a ceramic compound of silicon, a ceramic compound of antimony, a ceramic compound of gallium, a ceramic compound of zinc, a ceramic compound of copper, a ceramic compound of silver, and a ceramic compound of gold.

14. The method of operating a pressure disintegrable device of claim 8, wherein the second portion occupies 2% to 20% of a volume of the first volume.

15. The method of operating a pressure disintegrable device of claim 8, wherein the first portion is an alloy comprising at least one metal selected from the group consisting of aluminum, magnesium, titanium, iron, cobalt, nickel, copper, and zinc or the first portion is a ceramic material comprising at least one compound selected from the group consisting of oxides, nitrides, carbides, borides, and silicides.

16. A method of producing a pressure disintegrable device, comprising:

obtaining a first plurality of grains of a first material;

obtaining a second plurality of grains of a second material that decreases a melting point of the second material as an applied pressure increases beyond a predetermined pressure;

forming a first volume by:

forming a first portion by consolidating the first plurality of grains; and forming a second portion, disposed on the first portion, by consolidating the second plurality of grains; and applying, to the first volume, a layer disposed on the first volume and adapted to create a seal between the first volume and an external structure.

17. The method of producing a pressure disintegrable device of claim 16, wherein the second portion comprises:

at least one metal and at least one compound;

wherein the at least one metal is selected from the group consisting of bismuth, lead, tin, cadmium, germanium, silicon, antimony, gallium, zinc, copper, silver, and gold; and wherein the at least one compound is selected from the group consisting of an organometallic compound of bismuth, an organometallic compound of lead, an organometallic compound of tin, an organometallic compound of cadmium, an organometallic compound of germanium, an organometallic compound of silicon, an organometallic compound of antimony, an organometallic compound of gallium, an organometallic compound of zinc, an organometallic compound of copper, an organometallic compound of silver, an organometallic compound of gold, an inorganic compound of bismuth, an inorganic compound of lead, an inorganic compound of tin, an inorganic compound of cadmium, an inorganic compound of germanium, an inorganic compound of silicon, antimony, an inorganic compound of gallium, an inorganic compound of zinc, an inorganic compound of copper, an inorganic compound of silver, an inorganic compound, of gold, a ceramic compound of bismuth, a ceramic compound of lead, a ceramic compound of tin, a ceramic compound of cadmium, a ceramic compound of germanium, a ceramic compound of silicon, a ceramic compound of antimony, a ceramic compound of gallium, a ceramic compound of zinc, a ceramic compound of copper, a ceramic compound of silver, and a ceramic compound of gold.

18. The method of producing a pressure disintegrable device of claim 16, wherein the second portion occupies 2% to 20% of a volume of the first volume.

* * * * *